United States Patent [19]

Williamson

[11] 3,965,980

[45] June 29, 1976

[54] MUD SAVER VALVE

[75] Inventor: Joseph Stephen Williamson, Houston, Tex.

[73] Assignee: Smith International, Inc., Houston, Tex.

[22] Filed: Feb. 21, 1975

[21] Appl. No.: 551,897

[52] U.S. Cl. ..... 166/224 R; 137/496; 137/512.1; 175/65

[51] Int. Cl.[2] ..... E21B 7/00; F16K 3/02

[58] Field of Search ..... 166/224 R, 224 A; 175/65; 137/496, 512.1, 71, 493.1, 536, 512.2

[56] References Cited

UNITED STATES PATENTS

| | | | |
|---|---|---|---|
| 2,637,401 | 5/1953 | Ramsey | 166/224 R |
| 3,334,697 | 8/1967 | Edwards et al. | 166/224 R |
| 3,698,411 | 10/1972 | Garrett | 166/224 R |
| 3,698,426 | 10/1972 | Litchfield et al. | 137/512.1 |
| 3,738,436 | 6/1973 | Litchfield et al. | 175/65 |

*Primary Examiner*—James A. Leppink
*Attorney, Agent, or Firm*—Murray Robinson

[57] ABSTRACT

A drilling mud saver valve connected to the lower end of a kelly allows down flow of mud or other drilling fluid when pumps are actuated to circulate drilling fluid, but closes when the pumps are off, thereby retaining drilling fluid thereabove in the kelly to prevent loss of fluid when the kelly and valve are disconnected from the drill pipe.

The valve includes a tubular body and a top sub screwed therein. A replaceable seat is carried by the lower end of the top sub. A poppet type valve closure is urged upwardly against the seat by a helical spring strong enough to close the valve against the weight of drilling mud in the kelly.

The poppet valve closure has a central flow passage therethrough, communicating with the stem and controlled by an upwardly opening check valve, to communicate drill pipe pressure to the kelly when the pumps are off. The check valve closure is frangible for easy break out if wire line tools need to be run through the valve. The check valve closure includes a frangible metal disc threaded to a tubular metal guide stem and a polyurethane cover bonded to the disc. The cover has a snap-on lip extending down around the periphery of the disc, the lip being captured between the disc and guide stem, the lip also providing a seal ring the check valve closure to its seat.

The poppet valve closure has a tubular stem extending down through the spring. The stem has ports to allow fluid passing below the closure to enter the stem and flow down therethrough, bypassing an annular chamber between the stem and body in which the spring is disposed. The chamber is sealed by upper and lower semi-floating annular seal means between the stem and body and is kept at substantially atmospheric pressure. Pressure differential due to the sealed chamber holds the valve open without throttling when the valve opens. A soda straw type check valve controls a port in the sealed chamber and weeps if the seal means leaks.

The stem includes upper and lower sections having respectively downwardly and upwardly facing shoudlers. The sections are screwed together and provide screw jack means for initial compression of the spring to facilitate assembly; the spring being captured between the upper and lower seal means whose axial separation is limited by the shoulders.

The upper seal means includes upper and lower seal rings sealing between the stem and valve body. The inner lip on each of these seal rings is protected against assembly hang up by back up means including a back up ring for the upper seal ring. The back up ring is sealed to the stem by a stationary seal. The lower seal ring is backed up by the upper end of a spacer sleeve. The sleeve extends down below the threaded connection between the stem sections, sealing with the stem therebelow and thereabove and providing a bearing for the upper end of the spring. The back up ring and spacer ring are made of metal softer than steel.

28 Claims, 10 Drawing Figures

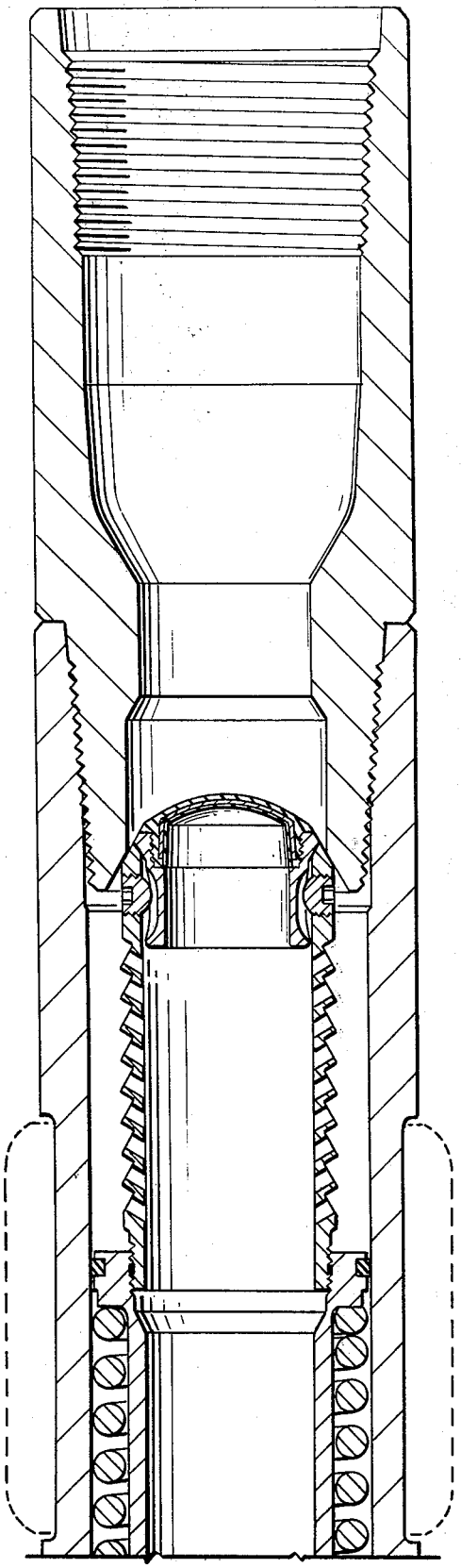
Fig. 7
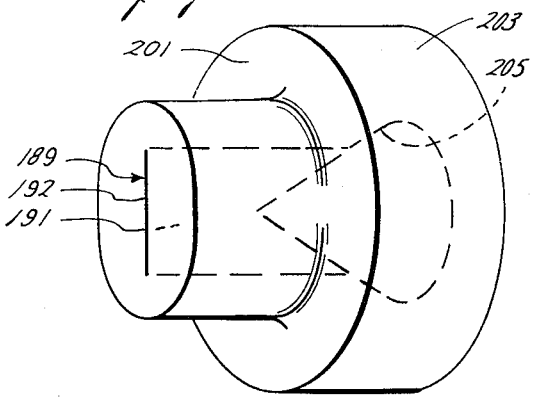
Fig. 1A
PRIOR ART
Fig. 1B
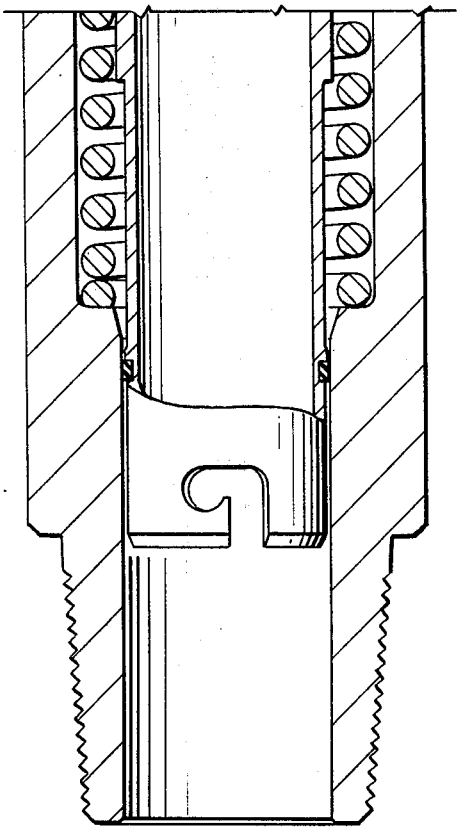

149
99
145
119
121
155
119
153
120
151
146
101
148
149
147
97
133
135
127
113
143
141
137
139
117
115
125
129
131
123
111
51
107
14
12
11
109
157
159
161
175
165
169
173
175
167
171
172
177
181
179
183
110
163
105
X

MUD SAVER VALVE

CROSS REFERENCES TO RELATED APPLICATION

This application relates to improvements upon the mud saver valve disclosed in the application of Walter Liljestrand Ser. No. 551,898 filed concurrently herewith, Feb. 21, 1975, entitled Mud Saver Valve, and to certain subject matter of the latter construction not claimed in the latter application.

BACKGROUND OF THE INVENTION

This invention relates to apparatus useful in the rotary method of earth boring and more particularly to mud saver valves used between the kelly and drill pipe to prevent loss of mud when the connection between the drill pipe and kelly is broken.

The prior art includes U.S. Pat. Nos. 3,698,426 and 3,738,436 issued on the applications of Litchfield, et al and U.S. Pat. No. 3,698,411 issued on the application of W. R. Garrett, and the prior patents cited against the application that matured into these three patents. Further included in the prior art is a valve hereinafter sometimes called the Model A valve, which is a commercial embodiment of the valve shown in the aforementioned Garrett patent. The Model A valve is illustrated and described as prior art in the aforementioned Liljestrand application. An experimental valve, sometimes hereinafter called theh Model X valve, embodied the construction of the preferred embodiment illustrated in the Liljestrand application.

The disclosures of the above mentioned Litchfield et al and Garrett patents and the Liljestrand application are incorporated herein by reference.

Briefly, the Model A valve, as shown in FIGS. 1A and 1B of the accompanying drawing, includes a tubular body having integrally formed on its lower end a tapered threaded pin connector. At its upper end the valve has a tapered threaded box formed upon the upper end of a tubular top sub screwed into the body. The lower end of the top sub is beveled to provide a poppet valve type seat. A poppet valve closure engageable with the underside of the seat is provided with a tubular stem extending downwardly therefrom. A helical spring disposed in an annular chamber between the stem and body biases the closure to closed position. The stem is ported so that when drilling fluid pressure overcomes the spring and opens the valve, the fluid that has passed down through the valve can move radially inwardly into the stem. The stem carries a radial flange exposed on its upper face to fluid pressure when the valve is open, thereby holding the valve open without throttling. The flange forms the upper end of the annular chamber and is sealed to the body by a sliding plastics material O-ring seal, e.g. a seal with the trade name Polypak made of polyurethane filled with molybdenum disulfide. The lower end of the stem is also sealed to the body by a sliding plastics material O-ring seal. The pressure in the sealed chamber to which the lower side of the flange is exposed, is below the pressure of the drilling fluid, e.g. atmospheric. The aforementioned Garrett patent teaches that this chamber is to be provided with a vent port, and in the Model A valve such a port was provided but it was normally closed by a screw plug. The spring bears at its lower end against a body shoulder forming the bottom of the chamber and at its upper end against the flange. The stem is partable just above the flange, the upper and lower parts of the stem being threadedly connected. The lower portion of the stem is provided at its lower end with J-slots for engagement with a pulling tool to compress the spring. During assembly the spring is compressed with the pulling tool enough to allow the top sub threads to engage the body threads. Final compression of the spring is effected by makeup of the top sub in the valve body. A check valve in the poppet valve closure opens upwardly to communicate drill pipe pressure to the kelly when the drilling fluid pumps are shut down. The check valve closure includes a central portion or cap which is frangible for breakout with a sinker bar in case it is necessary to run a wire line tool through the valve. The cap is aluminum covered with rubber for better wear, the rubber having threads on its outer periphery to engage threads on a metal ring which, together with the cap, form the check valve closure.

The Model X valve, shown in FIG. 2A and 2B of the accompanying drawings, improved upon the Model A valve by providing the lower end of the top sub with a removable replaceable elastomer ring forming the poppet valve seat. The valve body is enlarged adjacent the ported portion of the poppet valve stem. The lower portion of the valve stem is divided into two parts connected by a straight threaded connection. There is a downwardly facing shoulder on the upper part and an upwardly facing shoulder on the lower part. A floating annular seal means includes a metal ring or bridge that overlies the lower stem shoulder and an upwardly facing shoulder at the lower end of the sealed chamber. The lower end of the spring bears on the bridge and the upper end of the spring bears on the upper shoulder of the stem. During assembly, with the floating seal ring bearing on the shoulder on the lower part of the stem the two parts of the lower portion of the stem are screwed together to precompress the spring enough to allow the top sub threads to engage the body thread. This eliminates the need for a pulling tool. When the sub is fully made up with the body the spring is further compressed, the floating seal ring bearing on the body shoulder as the lower stem shoulder moves down away from the ring. The ring has a tail portion of smaller outer diameter than the upper part of the ring, the tail portion sealing with the body below the body shoulder. This insures that the force of the upward fluid pressure on the ring, which is transmitted through the spring to the valve stem, is less than the downward force on the stem flange.

Sealing is improved by providing stationary smaller unidirectional polyurethane lip seals between the floating seal ring and body and larger sliding unidirectional lip seals between the ring and stem, and by providing unidirectional polyurethane lip seals between the body and stem flange mounted in a back-up ring captured between the upper and lower portions of the stem when they are screwed together. Orientation means on the seals prevent assembly in the wrong direction.

The Model X valve also included improvements over the Model A valve that are the contributions of the present applicant, as follows: the check valve closure of the Model X valve included threads on the break-out disc to engage the check valve closure ring, eliminating the rubber threads on the cover which sometimes slipped. The rubber cover was bonded to the break-out disc and had a skirt extending over the threaded juncture of disc and ring. The check valve closure was provided with a longer guide stem to prevent objectionable canting. Protuberant ribs or wings on the rubber cover of the check valve break-out disc, which wings were a result of the molding procedure, were eliminated, since they cause turbulence. In assembly, the skirt on the rubber wear cover was used as a hand grip in place of the wings on the Model A valve.

SUMMARY OF THE INVENTION

The preferred embodiment of the present invention, shown in FIGS. 3A and 3B of the accompanying drawings, which embodiment and invention are hereinafter disclosed in more detail, includes certain features of the Model X valve not claimed in the Liljestrand application and certain other features representing improvements upon the Model X valve, as follows:

a. A single parting of the poppet valve stem into upper and lower sections joined together by a threaded connection suffices for both (i) the screw jack means used to compress the poppet valve spring and (ii) the mounting means for the upper seal means between poppet stem and valve body.

b. Elimination of protuberant inner lip on upper elastomeric sliding seal means that was apt to hang up during assembly on the valve stem. This is effected by backing up the inner lip with metal of the back-up ring, which in turn is sealed to the stem by a stationary seal in the form of an O-ring.

c. Addition of a non-steel metallic spacer beneath the upper seal means, which serves the functions of sealing the threaded connection between the upper and lower valve stem sections and providing a non-steel bearing surface with the steel valve body, eliminating the need for brazing a non-steel layer on the valve stem as was done in Model X.

d. The helical spring in the sealed chamber has thicker wire and hence is stiffer because the spring lies below the aforementioned spacer and in the larger volume portion of the chamber. (The chamber is smaller at its upper end because of the wall thickness of the threaded screw jack connection between the upper and lower parts of the lower portion of the valve stem.) In Model X a weaker spring was used because the spring extended in the chamber up to the stem shoulder where the chamber was smaller; thus causing a smaller coil spring to be used. The stiffer spring of the present invention provides for increased force between valve and seat when the valve is closed without the need for as much precompression as otherwise would be required.

e. A ckeck valve, preferably a soda straw action polyurethane check valve (known per se for auto tire valve covers but which seals against back pressures much in excess of that encountered as a tire valve cover), used to close the port of the sealed chamber, will weep if there is an accumulation of drilling fluid in the sealed chamber.

f. Wear cover on check valve closure is made of polyurethane instead of rubber for better wear characteristics and is provided with an inturned lip for snap-on assembly, thereby providing a longer life wear cover without assembly difficulty. The inturned lip also provides the following improvements:

1. a much better sealing surface between the closure and valve seat than the metal to metal surfaces of the Model A valve and the metal to metal with some rubber of the Model X valve;

2. the lip is clamped when assembled to assure proper adhesion, as the rubber cover lip of the Model X valve consistently tore off because of improper adhesion;

3. the lip acts as a lock washer on the shoulder between the break out disc and check valve guide stem.

BRIEF DESCRIPTION OF THE DRAWINGS

For a more detailed description of the invention, reference will now be made to the accompanying drawings wherein:

FIGS. 1A and 1B together form a vertical axial section, showing the prior art Model A mud saver valve;

FIG. 7 is a pictorial view of the tell-tale valve.

DESCRIPTION OF THE PREFERRED EMBODIMENT

BODY

Figure 2A:
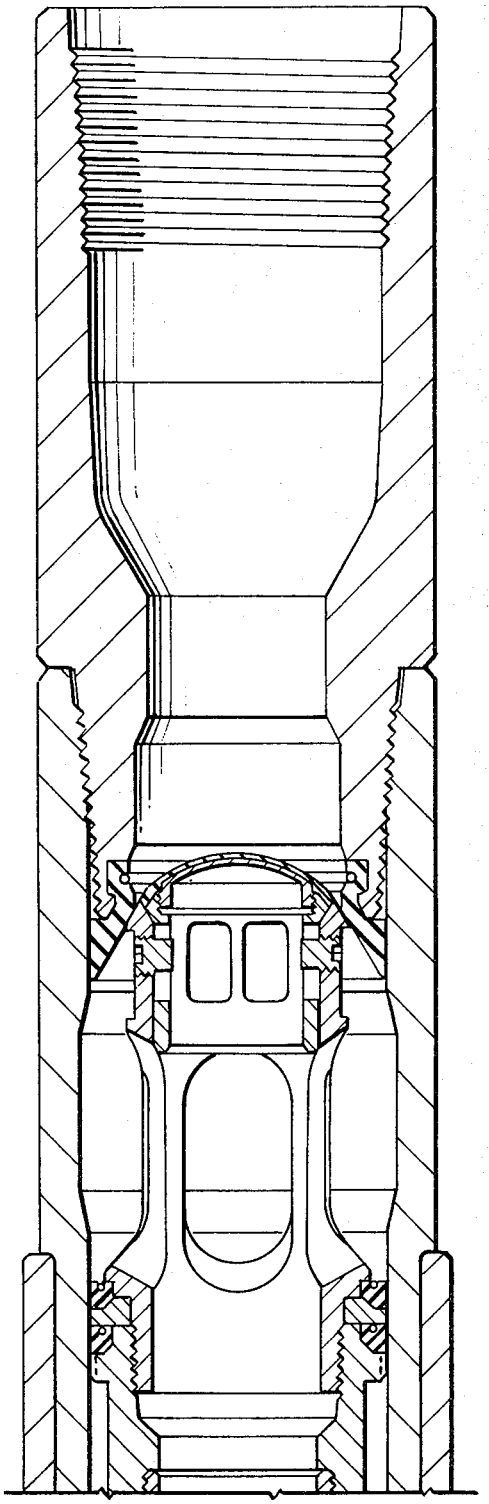
FIGS. 2A and 2B together form a vertical axial section, showing the Model X mud saver valve.
Figure 2B:
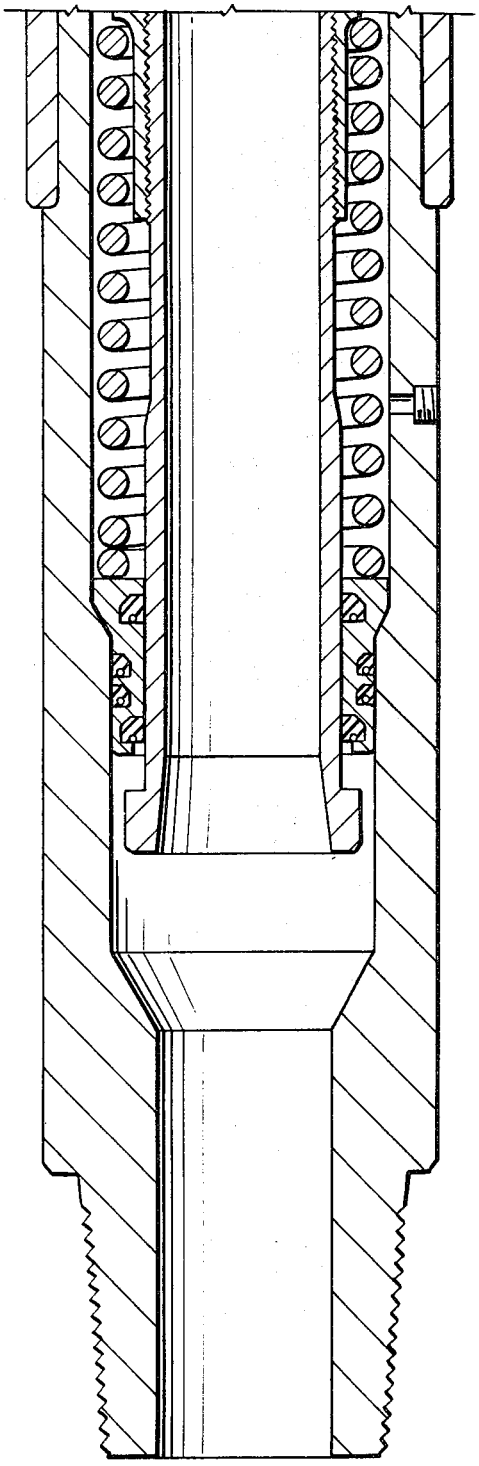
Figure 3A:
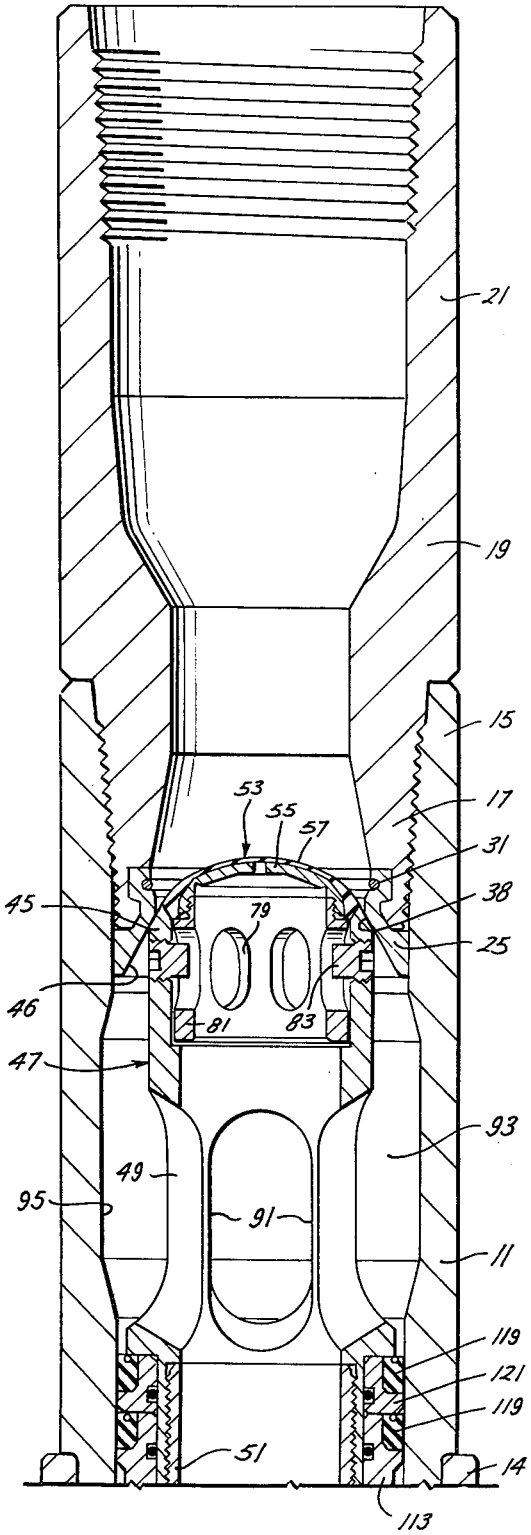
FIGS. 3A and 3B together form a vertical axial section, showing the Model B improved mud saver valve incorporating a preferred embodiment of the invention.
Figure 3B:
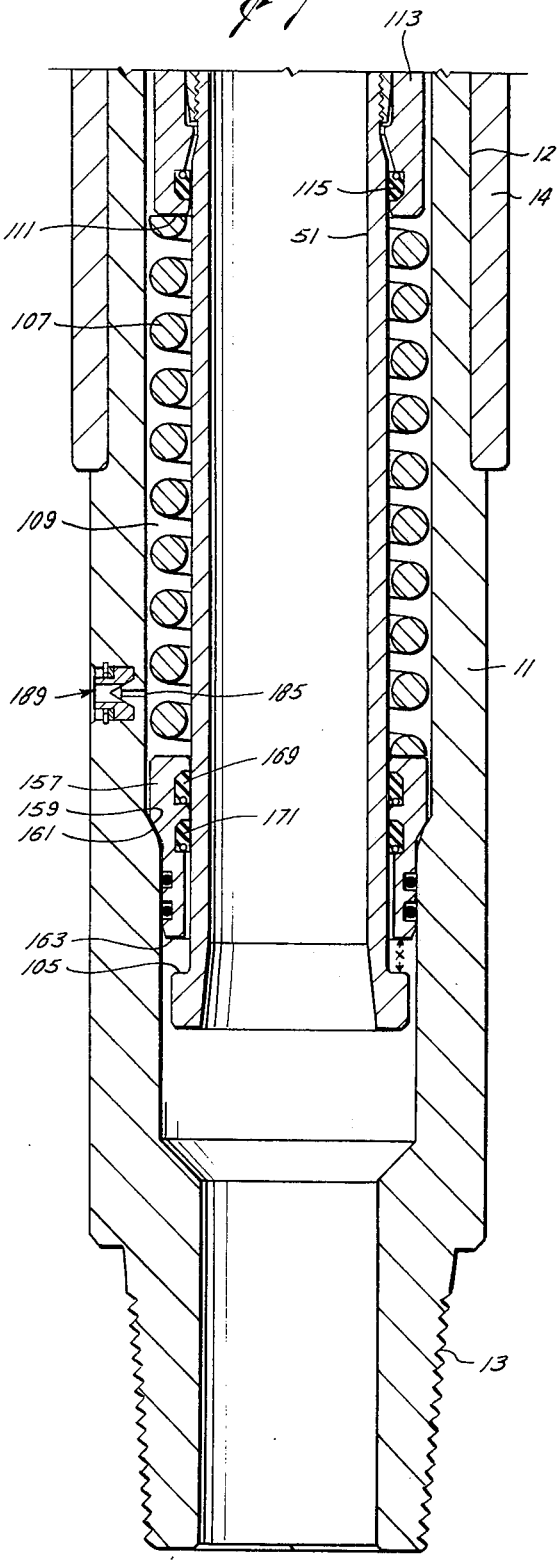

The prior art Model A valve shown in FIGS. 1A and 1B and the Model X valve shown in FIGS. 2A and 2B have already been described hereinabove. Reference will now be made to FIGS. 3A, 3B, and 3C which show the Model B valve and to FIGS. 4, 5, and 6 which show details thereof. The material of the valve is steel except as otherwise noted.

Referring now particularly to FIGS. 3A and 3B, the mud saver valve there shown includes a tubular body 11 having an annular groove 12 therearound to receive a rubber protector sleeve 14. The body has a tapered threaded pin 13 at its lower end for making a rotary shouldered connection with the upper end of a string of drill pipe. The upper end of the body 11 is provided with a tapered threaded body 15 for making a rotary shouldered connection with threaded pin 17 on top sub 19. A threaded body 21 or other suitable connector means is provided at the upper end of the sub 19 for making a rotary shouldered connection with the lower end of a kelly.

POPPET VALVE SEAT

Figure 4:
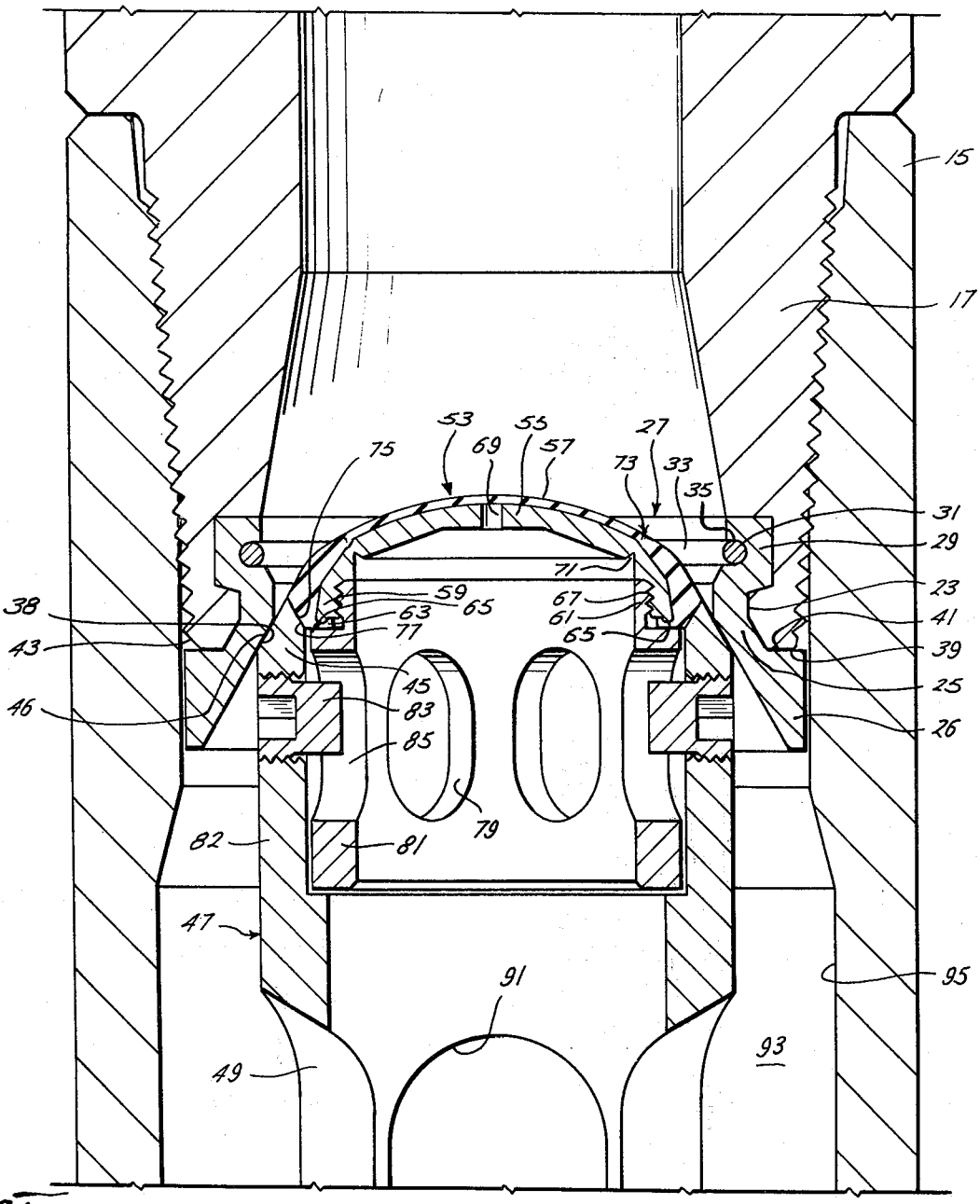
FIGS. 4, 5, and 6 are enlarged views corresponding to portions of FIGS. 3A and 3B, in particular FIG. 4 showing the check valve, FIG. 5 showing the screw jack, the sealed chamber, and the chamber seals, and FIG. 6 showing, to a still larger scale, the tell-tale valve for the sealed chamber.

Referring now to FIG. 4, the lower end of pin 17 is provided with a socket 23 for receiving neck 25 of an elastomeric seat ring 27. The neck 25 has an outwardly extending annular flange 29 received in annular groove 31 in the socket 23. A steel snap ring 33 received in annular groove 35 in neck 25 retains flange 29 in groove 31. The lower end portion 26 of seat ring 27 is tapered, flaring downwardly, providing a conical surface 38 to engage and seal with a correlative conical surface on a poppet valve closure to be hereinafter described. The shoulder 39 formed at the juncture of the seal portion and neck of the seat ring extends under the lower end 41 of the top sub 17 and is partially supported thereby, but the outer periphery of the lower end 41 is bevelled at 43 to facilitate entry of top sub 17 into box 15. The bevel 43 also eliminates sharp edges of thread run-out.

POPPET VALVE CLOSURE

The poppet valve closure includes a poppet ring 45 having an upwardly facing, downwardly flaring, conical outer peripheral seal face 46 for engagement and sealing with correlative surface 38 of the seat ring 27. Extending down from poppet ring 45 is poppet valve stem 47 which is tubular and includes an upper or cross over portion 49 and a lower or sealed chamber forming portion 51. The stem will be described in more detail hereinafter.

CAP

The poppet valve closure further includes a cap 53 comprising breakout disc 55 of aluminum or other brittle material and a polyurethane wear cover 57 snapped onto the disc. The disc has a downwardly extending peripheral flange 59 which is interiorly threaded for engagement with guide stem 61. The cover 57 extends around disc 55 and has a protuberant lip 63 which is snapped around lip 65 of disc 55. An adhesive such as epoxy may be used to further adhere the cover to the cap. When disc 55 is threadedly engaged with guide stem 61 the protuberant lip 63 of cover 57 is compressed and forms a lock-washer-like fitting tending to secure the threaded connection 67 between the cap and the guide stem. The disc 55 has a hole 69 in its center to allow for squeezing air bubbles from between the polyurethane cover 57 and disk 55 during adhesion of cover 57 to disc 55. The hole 69 might also serve as a means for holding disc 55 during machining of the threads thereon.

There is a circular downwardly opening notch 71 in the underside of the disc which is located at a radial distance from the cap center equal to the internal radius of the guide stem. Corresponding to the cap notch 71 is a circular notch or slit 73 in the top side of the polyurethane cover 57. When a problem is encountered making it necessary to lower tools into the drill pipe without removing the valve, a sinker bar may be lowered against the cap causing the disc and cover to break at the notches and fall into the drill pipe. After the problem has been corrected the valve can be easily restored to operative condition. The valve is first removed from the drill string then the top sub 17 is unscrewed from the valve body 11 and the remaining cap and cover pieces may then be unscrewed and easily replaced.

CHECK VALVE

The outer periphery of wear cover 57 is conical, flaring upwardly, providing a polyurethane seating surface 75 correlative to the conical, upwardly flaring steel seat 77 at the inner periphery of poppet ring 45. Together cap 53 and ring 45 form an upwardly opening check valve for detecting high pressure in the drill string. When the pressure in the drill string is higher than that of the mud above the valve, sometimes occurring when the mud pumps are shut off, the higher pressure will cause the check valve to open and drill pipe pressure to be transmitted back through the kelly to the pressure gauge to warn the operator not to break the pipe to mud saver valve connection.

CHECK VALVE CROSS OVER PORTION

The guide stem 61 of the check valve is provided with a plurality of radial ports 79 whereby the pressure of the drilling fluid, i.e. mud, from the drill string can enter the interior of the top sub 19. As the check valve opens due to the pressure below the mud saver valve, the pressure of the mud in the drill string is transmitted back into the valve, through the ports 79, and around the check valve cap 55 into the top sub flow passage. The amount of such reverse mud flow will not be great since the mud pumps limit such reverse flow.

CHECK VALVE STOP

Guide stem 61 has a downwardly extending tubular guide 81 adapted to slide inside the guide part 82 of upper poppet stem portion 49. A stop pin 83 screwed into guide part 82 extending into slot 85 in tubular guide 81 provides means to limit upward travel of the cap relative to the stem ring, thus insuring that the check valve is not forced into the kelly.

POPPET VALVE STEM CROSS OVER PORTION

Referring now to FIG. 3A the crossover portion 49 of the poppet valve stem 47 is provided with a plurality of large radial ports 91 whereby drilling fluid flowing down from the kelly past the poppet valve closure into annulus 93 between stem 49 and valve body 11 can enter the interior of stem 49 and thus pass on down the valve end into the drill pipe string. The interior of the valve body 11 is enlarged at 95 opposite the ported part of stem 49. This enlargement reduces the flow rate and lessens erosion of the stem ports 91.

SPRING CHAMBER

Figure 5:
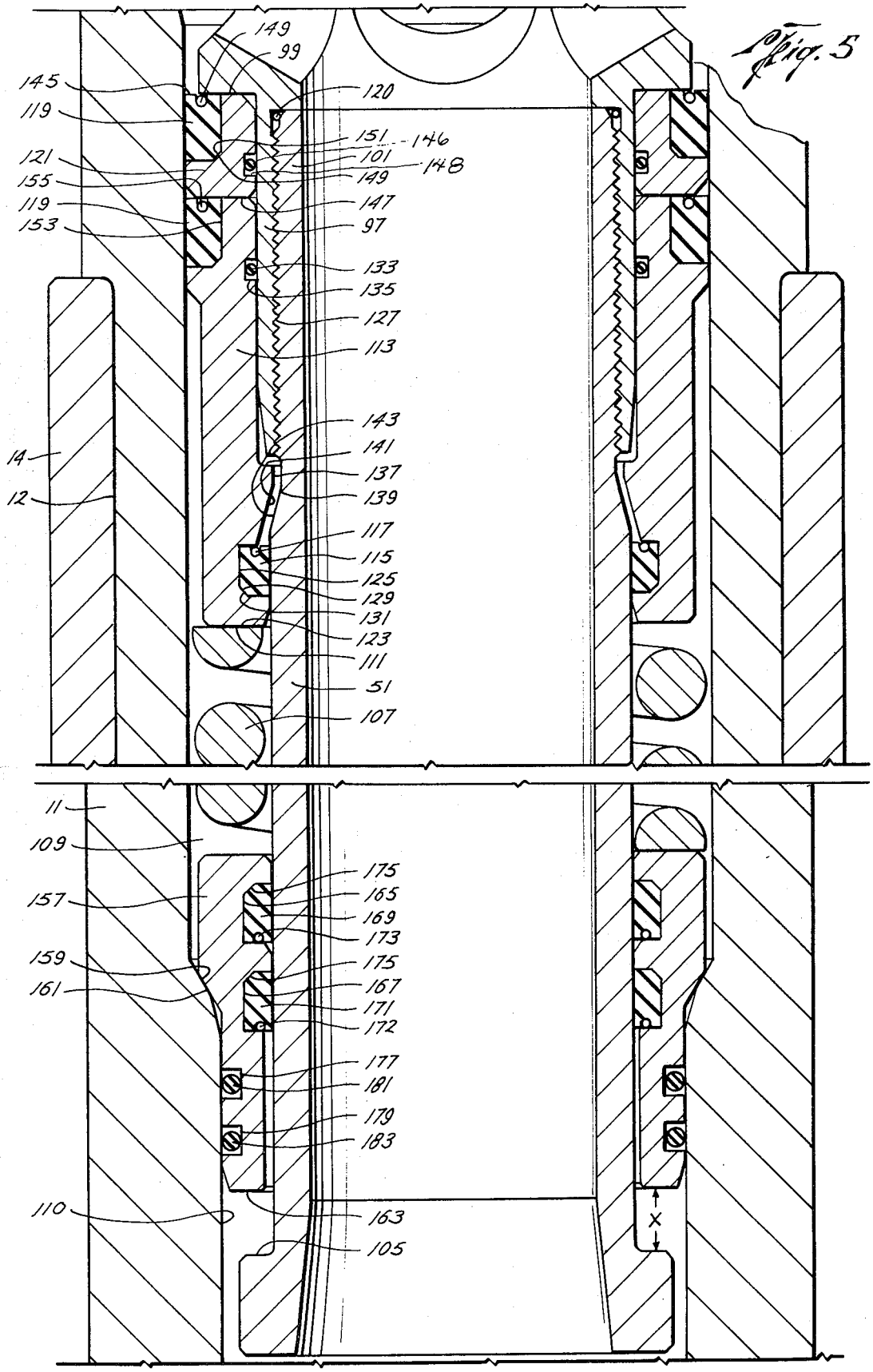

Referring now to FIG. 5, the lower end of cross over portion 49 of the poppet valve stem is provided with a straight threaded box 97 and a downwardly facing shoulder 99 making connection with straight threaded pin 101 on the lower portion 51 of the poppet valve stem. Stem 51 has an upwardly facing shoulder 105. Said stem pieces and the valve body form an annulus in which is housed a compression spring 107 placed around the stem and commpressed to bias the valve closure to the closed position. The annulus is sealed between upper shoulder 99 and near lower shoulder 105, forming a chamber sealed from other interior valve portions.

UPPER SEAL MEANS

Captured in the sealed spring chamber 109 between the downwardly facing shoulder 99 and the upper end 111 of the spring is the upper seal means comprising spacer 113, lip-type inner seal ring 115 with O-ring 117, lip-type outer seal rings 119 with O-rings 149, 155, and backup ring 121. This type of seal ring assembly comprising a lip-type seal ring with an O-ring inserted between the lips is commonly known to the art as a "Polypak". Such seals are typically used when sealing against high uni-directional pressures. Mud pressures on the order of 3,000 psi or more are commonly used during oil well drilling.

The spacer 113 performs the functions of both (i) providing a downwardly facing shoulder 123 against which the compression spring 107 bears and (ii) together with associated seals, sealing the threaded connection between the cross over portion of the poppet valve stem and the lower portion of said stem. The spacer is preferably formed of brass, bronze, or other metal softer than steel but with sufficient strength to hold the spring. The spacer provides a brass-to-steel bearing surface between the stem and the valve body.

The spacer 113 has an annular groove 125 within which is received seal ring 115 which seals against down flow from the threaded connection 127. The preferred type of seal ring 115 is a Polypak of polyurethane with the upper face parted by an annular groove to form inner and outer lips, the lips being separated by an O-ring 117. Orientation means consisting of bevel 129 on the seal ring matching correlative bevel 131 on the spacer 113, insures that the seal cannot be inadvertently assembled upside down. A stationary O-ring seal 133 is provided to fit in annular groove 135 and seal between the spacer and the lower part of the poppet valve stem cross over portion 49. The spacer 113, together with O-ring seal 133 and the Polypak seal 115, 117 effectively bridges the threaded connection 127; thus sealing it from the spring chamber 109. O-ring 120 inserted at the upper end of the threaded connection 127 also aids in sealing the chamber 109 from the interior portions of the valve.

A lip 137 is provided in the spacer which fits into the corresponding annular groove 139 in the lower stem piece 51. The lip has an downwardly facing surface 141 which is adapted to bear against the upwardly facing surface 143 formed at the lower end of threaded connection 127. The lip 137 and groove 139 are designed to prevent the circumstance where the valve opens and the stem moves downward but the upper seal means, exposed to the high mud pressure on the top side and substantially atmospheric pressure on the lower sealed chamber side, tends to move downward more than the valve stem. This could not happen here because the spacer lip 137 would engage valve stem groove 139 thus insuring that the valve stem and seal means will move downward together further opening the valve as desired.

The slight initial space between surfaces 141 and 143 of the lip and groove is merely an assembly feature insuring that the threaded connection 127 can be made up fully to compress seal ring 120 and exclude mud from the connection.

The upper shoulder 147 of the spacer 113 bears against backup ring 121. An O-ring 146 in groove 148 seals ring 121 to box 97 of the poppet valve stem. Backup ring 121 is constructed of brass, bronze, or other material softer than steel so as to provide a softer than steel, low friction, bearing surface. Backup ring 121 is of L-shaped cross section so as (i) to transmit the spring 107 loading to downwardly facing shoulder of the poppet valve stem 49 from the spacer 113 and also (ii) together with the valve body 11 and the poppet valve stem shoulder 99 to provide a groove or stuffing box for non-metallic upwardly facing, lip type seal ring 119. Ring 119 is similar to seal ring 115; the lips of ring 119 are kept parted by O-ring 149. The stuffing box extending to the stem shoulder 99 insures that in the assembly of the valve the seal ring 119 will not roll up. This top seal ring 119 prevents flow from the annulus 93 downwardly into sealed chamber 109 between the lower portion of the poppet valve stem 51 and valve body 11. The backup ring is beveled at 149 to correspond to orientation bevel 151 on seal ring 119 insuring proper assembly thereof.

Below backup ring 121 and lying in annular groove 153 in spacer 113 is upwardly facing lip-type seal ring 119 similar to seal ring 115, having O-ring 155 inserted into the lips and further sealing between the valve body and the valve stem. Since there is significant sliding between the poppet valve and the valve body, the sliding seals will become worn; having two seal rings allows for longer replacement life.

SCREW JACK

The spring chamber 109 formed between the poppet valve stem 49 and the inner periphery of valve body 11 contains compression spring 107. The spring bears on its upper end against the spacer 113 and on its lower end against bridge 157. Bridge 157 has a downwardly facing annular beveled shoulder 159 which seats on an upwardly facing beveled shoulder 161 in the valve body 11. Below shoulder 159 the bridge has a tail of smaller outer periphery. The lower end of the tail of the bridge has a downwardly facing shoulder 163 adapted to engage during assembly the upwardly facing shoulder 105 at the lower portion 51 of poppet valve stem 47.

The two piece valve stem 47, with the staight threaded connection 125 between its upper and lower parts, and the spacer 113, backup ring 121, and bridge 157 form a screwjack means for compressing the spring 107. During assembly the spring 107 is placed over the lower stem portion 51 and on top of bridge 157. Then the upper stem portion 49, which includes the poppet ring 45, is screwed onto lower stem portion 51 so that the spring is compressed about three inches. This assembly, together with the check valve at its upper end, is inserted in to the valve body 11 with the bridge 157 resting on shoulder 105. The pre-compression of the spring is sufficient so that the tapered threads on the pin 17 of the top sub 19 can engage the tapered threads in the box 15 at the upper end of valve body 11.

Elastomer valve seat 27, snapped into top sub 19, then rests against the poppet valve stem seat ring 45. When the pin 17 and box 15 are made up shoulder tight, the spring 107 is further compressed about 1/2-inch pushing stem 47 down and leaving distance X between bridge shoulder 163 and lower stem shoulder 105, as shown in the drawing. This is approximately the compression distance necessary to allow for manufacturing tolerances and still insure that the spring urges the poppet valve closure tightly against seat 27.

LOWER SEAL MEANS

The inner periphery of the bridge has two annular grooves 165, 167 within which are received two Polypak seal rings 169, 171 smaller, due to spatial considerations, than the large seal rings 115, 119 but of similar shape. The lips are kept parted by O-rings 173, 175. The seal rings 169, 171 are also provided with orientation means in the form of bevels 175 cooperating with correlative annular bevels in grooves 165, 167. The seal rings 169, 171 are downwardly facing and seal against upflow of drilling fluid from the interior of the valve body into sealed chamber 109.

The outer periphery of the bridge has two annular grooves 177, 179 within which are received O-rings 181, 183 to seal against upflow of drilling fluid from the interior of the valve body into sealed chamber 109. O-rings are suitable for use in the outer periphery of the bridge because there is little relative movement between the valve body and the bridge other than during assembly; thus, a lip-type sliding seal is not necessary. The lower seal rings 181, 183 seal against bore 110 which has a smaller diameter than sealed chamber 109.

POPPET VALVE ACTION

When the popper valve is closed the force of spring 107 is transmitted to the poppet valve stem through the upper seal means and stem shoulder 99. When the pumps are turned on, the pressure of drilling fluid on the poppet valve closure overcomes the spring force and opens the valve. The pressure of the drilling fluid above the upper seal means being greater than the atmospheric pressure in the sealed chamber caused the upper seal means to collapse the spring allowing the valve to stay open without throttling. The spring force is transmitted to the body through the bridge of the lower seal means and through the body shoulder 159. Since the seal rings 181, 183 on the tail of the lower seal means seal against bore 110 which has a smaller diameter than sealed chamber 109, the area of the lower seal means exposed to the pressure differential between the drilling fluid and atmospheric pressure is lesser than the area of the upper seal means exposed to such differential pressure, for which reason the lower seal means stays on the body shoulder as the upper seal means moves down to compress the spring. As the upper seal means moves down, the poppet valve stem moves down with it due to gravity, drag of the drilling fluid, friction between the inner periphery of the upper seal means and valve stem, and finally, if the other forces are insufficient, the upper seal means engages stem shoulder 143 and positively forces the valve stem down.

SEAL RING ASSEMBLY METHOD

As with the Model X valve, the construction is such that none of the Polypak seals needs to be stretched during assembly. This eliminates any assembly problem due to temporarily oversize seals which might occur because of the slowness of the polyurethane in returning to its original size after being stretched. Seal rings 119 are merely slipped over the tops of backup ring 121 and spacer 113. Seal rings 115, 169, 171 are not stretched to be assembled with spacer 113 and bringe 157 but instead are compressed. O-rings 133, 146 are similarly compressed or bent to place them in grooves 135, 148. Only O-rings 181, 183 need to be stretched during assembly and their cross sections are small enough so that they return to original size within a few seconds.

SODA STRAW CHECK VALVE

Figure 6:
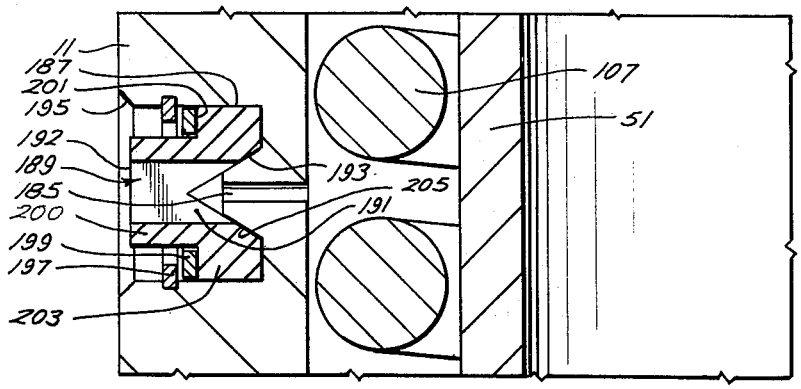

Referring now particularly to FIGS. 6 and 7, a port 185 is provided in the valve body 11, extending from the sealed chamber 109 to a chamber or socket 187 in the body within which is housed soda straw check valve 189. The socket 187 opens to the outer periphery of the valve body, thus providing a path for communication between the space outside the valve body and the sealed chamber 109.

The soda-straw check valve 189 gets its name from comparison with a soda-straw one end of which is collapsed. Suction on the collapsed end of a soda straw will result in fluid being forced out that end but a higher pressure or blowing on the collapsed end will result in the straw being even more collapsed and will not force fluid through the straw. In its construction check valve 189, resembles a collapsed soda straw. Soda straw check valve 189 comprises a body of elastomeric material including a base 203 of circular outer periphery and a beak 200 which is of smaller transverse dimensions and has a flattened oval cross section. The juncture of the beak and base flares to a shoulder 201. The beak of the valve, which is in communication with the exterior of the valve body is slit at 191, thereby resembling the collapsed end of a soda straw. The base of the valve, which is in communication with port 185, has a conical opening 205, analogous to the uncollapsed end of a soda straw. Opening 205 receives conical seat 193 that protrudes from the center of socket 187, concentric with port 185.

Check valve 189 rests slightly below the outer surface of valve body 11 which has been recessed at counterbore 195. The valve 189 is held in place by snap ring 197 engaging metal washer 199 which bears against shoulder 201 of the valve 189. The base 203 of the valve is slightly larger than the socket 187 whereby the valve is slightly compressed, thereby resiliently biasing the beak seat 192 to closed position.

A mud saver valve being just below the kelly is exposed to annulus pressure when in use; i.e., pressure in the space between the kelly and casing or wellhead or blowout preventer, which pressure may be very high. Since the check valve 189 is made of an elastomeric material, such as polyurethane, its massive base and frusto-conical inlet 205 are necessary to assure that the check valve 189 will not be extruded through port 185 due to a very high annulus pressure which may be encountered in drilling. For the same reason, port 185 is of relatively smaller diameter. If a high pressure in the sealed chamber is encountered the snap ring 197 and washer 199 assembly will hold check valve 189 in place.

When check valve 189 is assembled it forms an outwardly opening check valve to warn that there is seal leakage and the sealed chamber 109 is filling with drilling fluid which will restrict the spring 107 from closing the poppet valve. If fluid is in the sealed chamber 109, check valve 189 will weep a small amount of fluid through the end 192 of the valve. This fluid will be visible to an observer. Then, the mud saver valve is dismantled and all elastomeric seals replaced. Check valve 189 is not intended to function as a drain for the sealed chamber but as a tell-tale or detection device only.

OPERATION

When the mud saver valve is assembled between the kelly and drill pipe, the mud pumps are turned on and pump pressure of the drilling fluid opens the poppet valve. The larger stem flange area exposed to mud pressure when the poppet is open keeps the valve open without need for throttling. When it is desired to add a stand of drill pipe, the pumps are shut down. The remaining mud in the kelly exerts a hydrostatic pressure on the poppet valve but the helical spring is strong enough to rapidly close the poppet valve and keep it closed until the mud pumps are turned on again. The check valve opens if there is any pressure in the drill string above shut down pressure in the kelly, which warns the operator of such pressure. The check valve closes under the weight of drilling fluid in the Kelly after the operator has taken the necessary steps regarding the excessively high back pressure in the drill string. There is therefore no loss of drilling mud or other drilling fluid from the kelly. If it is necessary to lower a wire line tool through the valve, the cap can be broken through with a bar, lowered on a wire line through the kelly. The foregoing is the same as with the Model A valve.

If the poppet valve seal wears in use, it may be easily replaced. Since the spring is pre-compressed, the relative rotation of top sub and seal with respect to the poppet valve closure is so minimal that the soft replaceable seat is not damaged. The sealed chamber seals on the poppet valve stem are also easily replaced. If the lower portion of the stem is disassembled, e.g., for replacement of the inner seals on the bridge, the valve is easily reassembled with the screw-jack means. The foregoing is the same as with the model X valve.

Inspection of the soda-straw check valve in the lower valve body will warn that a seal or seals have failed and the spring chamber is filling with mud which will impair the action of the spring. If fluid is filling the spring chamber, the soda-straw check valve will weep or leak a small amount of drilling fluid through it to the outer valve body. The soda-straw check valve will leak when fluid in a pre-determined pressure range, e.g., 30–60 psi, is in the sealed chamber. The preferred time to inspect the soda-straw valve to determine if the sealed chamber is full or is filling with mud is when the valve is open and the mud pumps are on, thus producing the highest fluid pressure in the sealed chamber. This preferred inspection time is when the new joint of drill pipe has been lowered into the hole and the mud pumps are on and the mud is circulating the cuttings that settled out during the shutdown period.

While a preferred embodiment of the invention has been shown and described, modification thereof can be made of one skilled in the art without departing from the spirit of the invention.

I claim:

1. Mud saver valve adapted for connection between a kelly and a string of drill pipe including a tubular valve body having means at its lower end for making connection with a string of drill pipe and means at its upper end for making connection with a top sub, a tubular top sub having means at its upper end for making connection with a kelly and means at its lower end for making connection with said valve body, said top tub having a downwardly facing valve seat, closure means adapted to engage said valve seat and including a stem extending downwardly from said valve seat, said stem having a downwardly facing shoulder thereon, upper seal means bearing against said downwardly facing shoulder and sealingly engaging said stem and said valve body, spring support means including an upwardly facing shoulder in said valve body, a chamber formed by said valve stem, valve body, support means and upper seal means, spring means disposed in said chamber around said stem bearing at its lower end against said support means and biasing said closure means toward the closed position, distinguished by said spring means bearing at its upper end against said upper seal means, said upper seal means being held in position against said downwardly facing shoulder by said spring means that biases the closure means toward closed position.

2. Valve according to claim 1 further including:

alternative spring support means comprising an upwardly facing shoulder on a lower portion of the stem, and wherein said upper and lower stem portions are releasably connected and the chamber is sealed from the interior of the stem by said upper seal means which bridges across said releasable connection.

3. Valve according to claim 2 wherein said releasable connection consists of screw thread means, said stem, said alternative support means and upper seal means serving as a screw-jack to compress said spring means between said alternative support means bearing against the lower end of the spring means and said upper seal means bearing against the upper end of said spring means.

4. Valve according to claim 3 wherein said valve includes:

lower seal means around the stem overlying the valve body shoulder and the upwardly facing stem shoulder and sealingly engaging said stem and said valve body whereby said chamber is completely sealed from other interior portions of the valve by said lower and upper seal means, said spring means being compressed between said lower and upper seal means.

5. Valve according to claim 4 wherein said sealed chamber including a check valve having a port through the valve body communicating said sealed spring chamber with the outside surface of the valve body allowing the passage of fluid from inside the sealed chamber to outside of the valve body but preventing the passage of fluid from outside the valve body through said check valve and into the sealed chamber.

6. Valve according to claim 1 wherein said closure means includes a check valve for allowing pressure communication between the drill string and the kelly, said check valve including a port in the mud saver valve closure means providing a check valve seat, a downwardly extending check valve stem adapted to reciprocate within said check valve seat and check valve closure means atop said check valve stem, and having a seating surface adapted to seal with said check valve seat, said check valve closure means having a cap covered by a non-metallic wear cover turned down around the periphery of said cap to form said seating surface.

7. Valve according to claim 6 wherein said wear cover including inturned flange means for engaging said cap, said cap including metallic threads for engaging said check valve stem, and said check valve stem also including a shoulder engaging said inturned flange for preventing the closure wear cover check valve from being carried into the kelly.

8. Mud saver valve according to claim 6 said check valve stem having a length long enough to prevent said check valve closure from canting inside said poppet valve closure and thereby failing to maintain the closed position.

9. Mud saver valve according to claim 6 wherein said check valve cap includes a circular downwardly opening notch at maximum internal diameter of said guide stem so that it may serve as a break-out disc to facilitate the lowering of wire-line tools, said wear cover including also a circular upwardly opening notch corresponding to said cap notch so as to insure that it breaks in correlation to the check valve cap, said check valve cap also including metal threads for engaging with said poppet valve closure.

10. Mud saver valve according to claim 9 wherein said wear cover includes snap-on means for engaging said cap, said snap-on means including a lip which is captured between the cap and the guide stem.

11. Mud saver valve according to claim 10 wherein said snap-on means includes adhesive means to insure said wear cover adheres to said cap.

12. Mud saver valve adapted for connection between a kelly and a string of drill pipe including a tubular valve body having an inlet and an outlet with a flow passage therethrough, closure means adapted for blocking said passage, mounting means for mounting said closure means for reciprocation between a position blocking flow through said fluid passage and a position leaving said passage open for fluid flow therethrough, said mounting means including a stem axially movable in said valve body, said stem being radially spaced from the interior of said valve body forming an annular chamber therebetween, upper seal means disposed between the tubular valve body and said stem, said valve body having an upwardly facing shoulder in said chamber, bridge means around said stem overlying said body shoulder, lower seal means comprising stationary seal means between said bridge and the valve body and slidable seal means between said bridge and said stem, said upper and lower seal means sealing said chamber from interior portions of the valve, spring means for urging said valve closure means to said position blocking flow through said passage, said spring means being disposed around said stem in said annular chamber, said stem forming a screw-jack for placing said spring means in compression so that it bears at its lower end against said bridge and at its upper end against said upper seal means.

13. Mud saver valve according to claim 12 wherein said screw thread means connecting the upper and lower parts of the stem is a straight-threaded screw connection and is located between the upper and lower seals, said stem having only two pieces.

14. Mud saver valve according to claim 8 wherein said upper and lower seal means include upper and lower unidirectional means sealing preferentially in one direction and orientation means on the unidirectional sealing means to insure proper assembly thereof, said upper unidirectional means lying between said spacer and said downwardly facing stem shoulder, said upper unidirectional means including a metallic back-up ring so as to insure that said upper unidirectional means will not roll up during assembly thereof.

15. Mud saver valve adapted for connection between a kelly and a string of drill pipe including a tubular valve body having means at its lower end for making connection with a string of drill pipe and means at its upper end for making connection with a top sub, a tubular top sub having means at its upper end for making connection with a kelly and means at its lower end for making connection with said valve body, said top sub having a downwardly facing valve seat, closure means adapted to engage said valve seat and including a stem extending downwardly from said valve seat, said stem having two pieces releasably connected together by a straight threaded screw connection and including a lower piece having an upwardly facing shoulder thereon and an upper piece having a downwardly facing shoulder thereon, upper seal means around said stem bearing against said downwardly facing shoulder and sealingly engaging said stem and said valve body, said valve body having an upwardly facing shoulder, lower seal means around said stem overlying said valve body shoulder and said upwardly facing stem shouder, and sealingly engaging said stem and valve body, an annular chamber formed by said valve stem, valve body, lower seal means and upper seal means, spring means disposed in said chamber atound said stem bearing at its lower end against said lower seal means and biasing said closure means toward the closed position, distinguished by said spring means bearing at its upper end against said upper seal means, said upper seal means being held in position against said downwardly facing shoulder by the said spring means that biases the closure means toward the closed position, and said upper seal means including a spacer extending downwardly past the screw connection in the stem and inside the valve body to engage the upper end of said spring means and which transmits the compression force from the upper end of the spring means to said downwardly facing shoulders on the upper piece of the stem.

16. Mud saver valve according to claim 15 wherein said spacer bridges said straight threaded screw connection and contains seal means to seal with the lower piece of said stem below said threaded connection thereby sealing said chamber from fluid leakage through said threaded connection.

17. Mud saver valve according to claim 15 wherein said spacer includes a downwardly facing shoulder oppositely disposed from an upwardly facing shoulder on the lower piece of the stem so as to insure that the spacer will not slide down axially relative to the stem beyond the position of engagement of said shoulders.

18. Mud saver valve adapted for connection between a kelly and a string of drill pipe including a tubular valve body having an inlet and an outlet with a flow passage therethrough, closure means adapted for blocking said passage, mounting means for mounting said closure means for reciprocation between a position blocking flow through said fluid passage and a position leaving said passage open for fluid flow therethrough, said mounting means including a stem axially movable in said valve body, said stem being radially spaced from the interior of said valve body forming an annular chamber therebetween, upper seal means disposed between the tubular valve body and said stem, said valve body having an upwardly facing shoulder in said chamber, lower seal means around said stem overlying said body shoulder sealing between the valve body and said stem, said upper and lower seal means sealing said chamber from interior portions of the valve, spring means for urging said valve closure means to said position blocking flow through said passage, said spring means being disposed around said stem in said annular chamber, wherein said annular chamber contains check valve means for detecting fluid in said sealed chamber, said check valve means including a port in the tubular valve body extending into the chamber and a collapsed soda-straw valve assembly which allows passage of mud only from the chamber to the outside annulus around said valve body.

19. Mud saver valve according to claim 14 wherein said soda-straw valve assembly includes a massive disk-like base to prevent inward collapse and a slitted member disposed thereon to insure that any fluid in the chamber will pass only from the chamber to the annulus outside the valve body, said soda-straw valve assembly disposed within said valve body port and restrained so as to prevent outward extrusion of the soda-straw assembly through said port.

20. Mud saver valve adapted for connection between a kelly and a string of drill pipe including a tubular valve body having an inlet and an outlet with a flow passage therethrough, poppet valve closure means adapted for blocking said passage, mounting means for mounting said closure means for reciprocation between a position blocking flow through said fluid passage and a position leaving said passage open for fluid flow therethrough, said mounting means including a stem axially movable in said valve body, said stem being radially spaced from the interior of said valve body forming an annular chamber therebetween, upper seal means disposed between the tubular valve body and said stem, said valve body having an upwardly facing shoulder in said chamber, lower seal means around said stem overlying said body shoulder for sealing between the tubular valve body and said stem, said upper and lower seal means sealing said chamber from interior portions of the valve, spring means for urging said valve closure means to said position blocking flow through said passage, said spring means being disposed around said stem in said annular chamber between said upper and lower seal means, said poppet valve closure including a first upwardly opening check valve for pressure communication between said drill string and the kelly, said valve body including a second outwardly opening check valve communicating said annular chamber with the exterior of the valve body for detecting liquid in said chamber.

21. Mud saver valve adapted for connection between a kelly and a string of drill pipe including a hollow body having means at its lower end for making connection with a string of drill pipe and means at its upper end for making connection with a kelly, said body having a downwardly facing valve seat, closure means adapted to engage said valve seat and including a stem extending downwardly from said valve seat, said stem having a downwardly facing shoulder thereon, upper seal means around said stem bearing against said downwardly facing shoulder and sealingly engaging said stem and said valve body, said valve body having an upwardly facing shoulder, lower seal means around said stem overlying said valve body shoulder, a sealed chamber formed between said valve body and said stem and said upper and lower seal means, and check valve means in said chamber for detecting seal failure, said check valve means providing for outflow of fluid from said chamber to the exterior of the valve when pressure in the annular chamber is above that outside the valve but preventing flow in the reverse direction.

22. Mud saver valve according to claim 21 wherein said check valve means includes a porthole in the body allowing communication between the sealed chamber and the annulus around said valve body, and a collapsed soda-straw valve assembly which permits the passage of fluid in only one direction.

23. Mud saver valve according to claim 22 wherein said soda-straw valve allows fluid to pass only from the sealed chamber to the annulus surrounding the valve body, said soda straw valve having a frusto-conical inlet around said porthole and a slitted outlet, said valve being disposed within a chamber in the lower side of the body, said chamber encompassing said porthole.

24. Mud saver valve according to claim 23 wherein said soda-straw valve includes a massive disk-like base to prevent inward collapse and extrusion due to a large negative pressure differential across said valve and retention means to prevent said valve from collapsing outwardly due to a large positive pressure differential across said valve, said retention means including a washer and snap ring assembly.

25. Mud saver valve adapted for connection between a kelly and a string of drill pipe including a tubular valve body, an upwardly facing poppet valve having a downwardly extending stem, check valve means in said poppet valve for detecting high pressure in the string of drill pipe, said check valve means including a downwardly extending guide stem and closure means seating on said poppet valve, said closure means including a frangibly breakable cap threadedly engageable with said guide stem, said cap including a wear cover having an in-turned lip, said lip being captured between said cap and said guide stem and serving as a lockwasher therebetween.

26. Mud saver valve according to claim 25 wherein said cap is circularly notched on the underside so as to breakaway as a complete disk, said notches made at a radial displacement corresponding to the internal radius of said guide stem, said wear cover is circularly notched on the top side so as to breakaway with said disk, said wear cover notches being radially displaced corresponding to said cap notches.

27. Mud saver adapted for connection between a elly and a string of drill pipe including a tubular valve body, an upwardly facing poppet valve having a downwardly extending stem, check valve means in said poppet valve for detecting high pressure in the string of drill pipe, said check valve means including a downwardly extending guide stem and closure means seating on said poppet valve, said closure means including a frangible cap threadedly engageable with said guide stem, said cap including a wear cover, said cap being circularly notched on the underside so as to breakawaay as a complete disk, the notch location being at a radial distance from the center of the cap corresponding to the internal radius of said guide stem, said wear cover being circularly notched on the top side so as to breakaway with said disk, the notch location in said wear cover being at a radial distance from the center of the cap corresponding to the cap notch location.

28. Mud saver valve adapted for connection between kelly and a string of drill pipe including a tubular valve body having means at its lower end for making connection with a string of drill pipe and means at tis upper end for making connection with a top sub, a tubular top sub having means at its upper end for making connection with a kelly and means at its lower end for making connection with said valve body, said top sub having a downwardly facing valve seat, closure means adapted to engage said valve seat and including a stem extending downwardly from said valve seat, said stem having two pieces releasably connected together by a straight threaded screw connection and including a lower piece having an upwardly facing shoulder thereon and an upper piece having a downwardly facing shoulder thereon, upper seal means around said stem against said downwardly facing shoulder and sealingly engaging said stem and said valve body, said valve body having an upwardly facing shoulder, lower seal means around said stem overlying said valve body shoulder and said upwardly facing stem shoulder, and sealingly engaging said stem and valve body, an annular chamber formed by said valve stem, valve body, lower seal means and upper seal means, spring means disposed in said chamber around said stem bearing at its lower end against said lower seal means and biasing said closure means toward the closed position, distinguished by said spring means bearing at its upper end against said upper seal means, said upper seal means being held in position against said downwardly facing shoulder by the said spring means that biases the closure means toward the closed position, said upper seal means being annular and assembleable against said downwardly facing shoulder by threading therethrough the lower end of the upper piece of said stem when the connection between the two pieces is released, said upper seal means being removable from said stem by moving it axially away from said downwardly facing shoulder and off the lower end of said upper piece of the stem when said connection is released, whereby said releasable connection serves the dual function of a screw jack for initial compression of said spring prior to insertion thereof in said body and of a partable connection to allow assembly and disassembly of said upper seal means.

* * * * *

UNITED STATES PATENT AND TRADEMARK OFFICE

CERTIFICATE OF CORRECTION

PATENT NO. : 3,965,980

DATED : June 29, 1976

INVENTOR(S) : JOSEPH STEPHEN WILLIAMSON

It is certified that error appears in the above-identified patent and that said Letters Patent are hereby corrected as shown below:

In the Abstract

Line 26, after "ring", insert --to seal--.

Figure 4, the lead line for reference number 31 should be connected to the annular groove which receives annular flange 29.

Column 1, line 30, change "theh" to --the--.

Column 3, line 52, change "ckeck" to --check--.

Column 4, line 46, change "body" to --box--.

Column 4, line 48, change "body" to --box--.

Column 8, line 21, after "the" (second occurrence) change "staight" to --straight--.

Column 9, line 3, change "popper" to --poppet--.

UNITED STATES PATENT AND TRADEMARK OFFICE

CERTIFICATE OF CORRECTION

PATENT NO. : 3,965,980

DATED : June 29, 1976

INVENTOR(S) : JOSEPH STEPHEN WILLIAMSON

It is certified that error appears in the above-identified patent and that said Letters Patent are hereby corrected as shown below:

Column 9, line 10, change "caused" to --causes--.

Column 10, line 29, change "smaller" to --small--.

Column 11, line 3, after "wears", insert --out--.

Column 11, line 32, change "of" to --by--.

Column 12, line 12, after "and", insert --said--.

Column 13, line 56, change "8" to --12--.

Column 17, line 13, after "saver", insert --valve--.

Column 17, line 14, change "elly" to --kelly--.

Column 2, line 19, change "Fig." to --Figs.--.

Column 7, line 26, change "an" to --a--.

Column 8, line 22, change "125" to --127--.

Column 8, line 52, change "175" to --172--.

Column 9, line 36, change "oversize" to --oversized--.

Column 9, line 41, change "bringe" to --bridge--.

UNITED STATES PATENT AND TRADEMARK OFFICE

CERTIFICATE OF CORRECTION

PATENT NO. : 3,965,980

DATED : June 29, 1976

INVENTOR(S) : JOSEPH STEPHEN WILLIAMSON

It is certified that error appears in the above-identified patent and that said Letters Patent are hereby corrected as shown below:

Column 11, line 45, change "tub" to --sub--.

Column 13, line 1, delete "it" and insert--said check valve cap--.

Column 13, line 5, delete "it" and insert --said wear cover--.

Column 13, line 43, after "said", delete "valve".

Column 13, line 48, delete "it" and insert --said spring--.

Column 14, line 24, change "shouder" to --shoulder--.

Column 14, line 28, change "atound" to --around--.

Column 17, line 27, change "breakawaay" to --breakaway--.

Column 17, line 40, change "tis" to --its--.

Signed and Sealed this

Fourteenth Day of December 1976

[SEAL]

*Attest:*

RUTH C. MASON
*Attesting Officer*

C. MARSHALL DANN
*Commissioner of Patents and Trademarks*